US008587510B2

(12) United States Patent
Nagasawa et al.

(10) Patent No.: US 8,587,510 B2
(45) **Date of Patent: *Nov. 19, 2013**

(54) INFORMATION PROCESSING APPARATUS AND CONTROL METHOD

(71) Applicant: Kabushiki Kaisha Toshiba, Minato-Ku (JP)

(72) Inventors: Norikazu Nagasawa, Ome (JP);

(73) Assignee: Kabushiki Kaisha Toshiba (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/724,888

(22) Filed: Dec. 21, 2012

(65) Prior Publication Data

US 2013/0120236 A1 May 16, 2013

Related U.S. Application Data

(63) Continuation of application No. 11/824,354, filed on Jun. 29, 2007, now Pat. No. 8,363,002.

(30) Foreign Application Priority Data

Jun. 30, 2006 (JP) ..... 2006-182049

(51) Int. Cl.
*G09G 3/36* (2006.01)

(52) U.S. Cl.
USPC ..... 345/102

(58) Field of Classification Search
USPC ..... 345/102, 211
See application file for complete search history.

(56) References Cited

U.S. PATENT DOCUMENTS

| | | | |
|---|---|---|---|
| 6,552,711 | B1 | 4/2003 | Nakamura |
| 6,812,649 | B2 | 11/2004 | Kim |
| 6,954,191 | B1 | 10/2005 | Hirano |
| 7,176,878 | B2 | 2/2007 | Lew et al. |
| 7,277,075 | B1 | 10/2007 | Hirano et al. |
| 7,339,570 | B2 | 3/2008 | Kubota et al. |
| 2003/0193472 | A1 | 10/2003 | Powell |

(Continued)

FOREIGN PATENT DOCUMENTS

| | | |
|---|---|---|
| CN | 1991541 A | 7/2007 |
| JP | 2001-108961 | 4/2001 |

(Continued)

OTHER PUBLICATIONS

English Translation of Chinese Office Action dated Mar. 6, 2009.

(Continued)

*Primary Examiner* — Allison Walthall
(74) *Attorney, Agent, or Firm* — Knobbe Martens Olson & Bear, LLP

(57) ABSTRACT

According to one embodiment, an information processing apparatus includes a displaying unit including a display panel, a drive circuit for driving a white pixel, an illumination unit, and an inverter supplying a boosted driving power to the illumination unit, a power supply which supplies the inverter the driving power corresponding to a second control signal, a selecting unit which selects one item of setting data from a setting table including a plurality of items of setting data including luminance setting of the white pixel and luminance setting of the illumination unit, a first control signal outputting unit which supplies to the drive circuit the first control signal corresponding to luminance of the white pixel included in the selected item, and a second control signal outputting unit which supplies to the power supply the second control signal corresponding to luminance of the illumination unit included in the selected item.

8 Claims, 6 Drawing Sheets

(56) References Cited

U.S. PATENT DOCUMENTS

| | | | |
|---|---|---|---|
| 2005/0057484 | A1 | 3/2005 | Diefenbaugh et al. |
| 2005/0140612 | A1 | 6/2005 | Baek |
| 2006/0022992 | A1 | 2/2006 | Tsuji et al. |
| 2006/0139527 | A1 | 6/2006 | Chang et al. |

FOREIGN PATENT DOCUMENTS

| | | |
|---|---|---|
| JP | 2002-032048 | 1/2002 |
| JP | 2003-241165 | 8/2003 |
| JP | 2005-196175 | 7/2005 |
| JP | 2006-3475 | 1/2006 |
| JP | 2006-039520 | 2/2006 |

OTHER PUBLICATIONS

Office Action issued on Mar. 6, 2012 in connection with related Japanese Patent Application No. JP 2006-182049.

Office Action mailed on May 29, 2012 in Japanese Patent Application No. JP 2006-182049.

Office Action issued on Sep. 4, 2012 in connection with corresponding Japanese Application No. 2006-182049.

Transmission LCD

| | AC power source drive | Battery drive | |
|---|---|---|---|
| | | Normal | Long-life |
| White pixel | On | Off | On |
| Backlight | Hi | Middle | Low |

Translucent LCD

| | AC power source drive | Battery drive | |
|---|---|---|---|
| | | Normal | Long-life |
| White pixel | On | Off | On |
| Backlight | Hi | Middle | Off |

FIG. 5

Reflection LCD

| | AC power source drive | Battery drive | |
|---|---|---|---|
| | | Normal | Long-life |
| White pixel | On | Off | On |
| Backlight | Hi | Middle | Off |

FIG. 6

INFORMATION PROCESSING APPARATUS AND CONTROL METHOD

CROSS-REFERENCE TO RELATED APPLICATIONS

This application is a continuation of U.S. patent application Ser. No. 11/824,354, filed Jun. 29, 2007, and entitled "INFORMATION PROCESSING APPARATUS AND CONTROL METHOD," which is based upon and claims the benefit of priority from Japanese Patent Application No. 2006-182049, filed Jun. 30, 2006, the entire contents of each of which are incorporated herein by reference.

BACKGROUND

1. Field

One embodiment of the invention relates to a display panel having an LCD of an RGBW type and an illumination unit, an information processing apparatus having the display panel, and a control method.

2. Description of the Related Art

An LCD (Liquid Crystal Display) is widely used as a display apparatus of a notebook personal computer and a car navigation system.

At present, an LCD of an RGBW type is suggested in order to increase luminance.

Jpn. Pat. Appln. Publication No. 2006-3475 discloses an organic electroluminescent apparatus for controlling a use rate (luminance) of a W pixel by an inputting means (input button) for power-saving display. As to the LCD of the RGBW type, luminance of a W pixel can be changed by an inputting means similar to a technique described in the Jpn. Pat. Appln. Publication No. 2006-3475.

Liquid crystal itself does not emit light, and an LCD is combined with illumination such as backlight so that the user can see an image. Amount of power consumed by the backlight is larger than that of the LCD. Therefore, in a case of the notebook personal computer, luminance of the backlight is automatically lowered at the time the notebook personal computer is driven by a battery to extend driving time. When luminance of the backlight is lowered, there is a case where visibility becomes worse.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

FIG. 5 is an exemplary view showing a content of a synchronization data table in a case of a translucent LCD;

FIG. 6 is an exemplary view showing a content of a synchronization data table in a case of a reflection LCD;

DETAILED DESCRIPTION

Various embodiments according to the invention will be described hereinafter with reference to the accompanying drawings. In general, according to one embodiment of the invention, an information processing apparatus comprises a displaying unit including a display panel which includes a liquid crystal panel including a red pixel, a green pixel, a blue pixel, and a white pixel, a drive circuit for driving the white pixel corresponding to a first control signal, an illumination unit for illuminating the liquid crystal panel, and an inverter for boosting a supplied drive voltage and supplying the boosted a driving power to the illumination unit, a display controller that controls the red pixel, the green pixel, and the blue pixel to display an image, a power supply that supplies the inverter the driving power including a voltage value corresponding to a second control signal, a selecting unit that selects one item of setting data from a setting table including a plurality of items of setting data including luminance setting of the white pixel and luminance setting of the illumination unit, a first control signal outputting unit which supplies to the drive circuit the first control signal corresponding to luminance of the white pixel included in the item of the setting data selected by the selecting unit, and a second control signal outputting unit which supplies to the power supply the second control signal corresponding to luminance of the illumination unit included in the item of the setting data selected by the selecting unit.

An embodiment of the present invention will be described with reference to the accompanying drawings.

Figure 1:
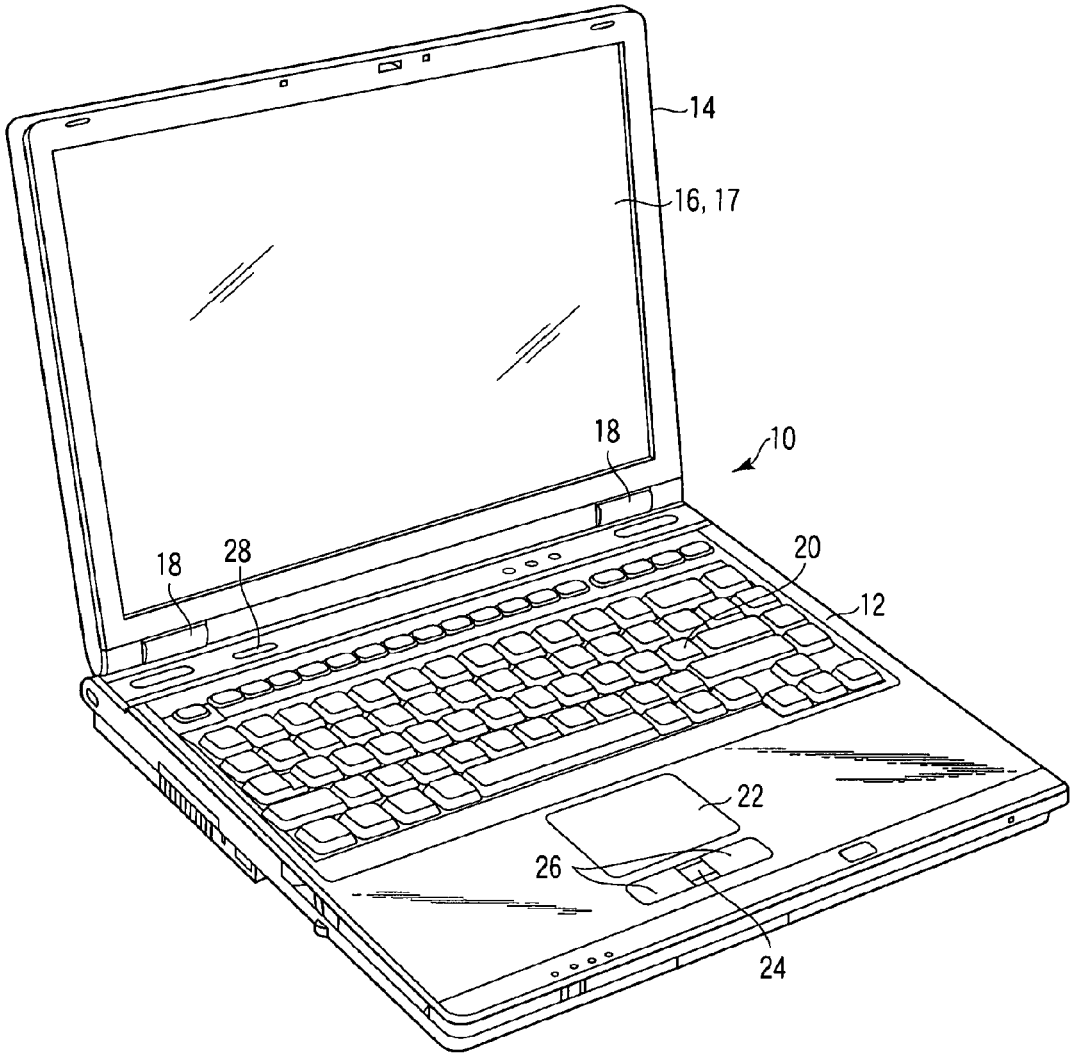
FIG. 1 is an exemplary perspective view showing an example of a schematic configuration of a personal computer as an information processing apparatus according to a first embodiment of the present invention.

FIG. 1 is a view showing an example of a configuration of a notebook personal computer as an information processing apparatus according to a first embodiment of the present invention.

A personal computer 10 is configured with a computer main body 12 and a display unit 14. The display unit 14 incorporates a display panel 16 having an LCD (Liquid Crystal Display).

The display unit 14 as a displaying unit is attached to a hinge (supporting part) 18 provided at an edge portion on a rear side of the computer main body 12 so as to rotatably change between an open position for covering a top surface of the computer main body 12 and a close position for making the top surface of the computer main body 12 to be exposed.

The computer main body 12 has a cabinet with a shape of a shallow box. A keyboard 20 is provided on a center portion of a top surface of the cabinet. A palm rest is formed on a front side of the top surface of the cabinet part of the computer main body 12. A substantial center portion of the palm rest is provided with a touch pad 22, a scroll button 24, and a touch pad control button 26. On a rear side of the top surface of the cabinet part of the computer main body 12, a power button 28 for turning on and off power of the computer main body 12 is arranged.

Next, an example of a system configuration of the present computer will be described with reference to FIG. 2.

Figure 2:
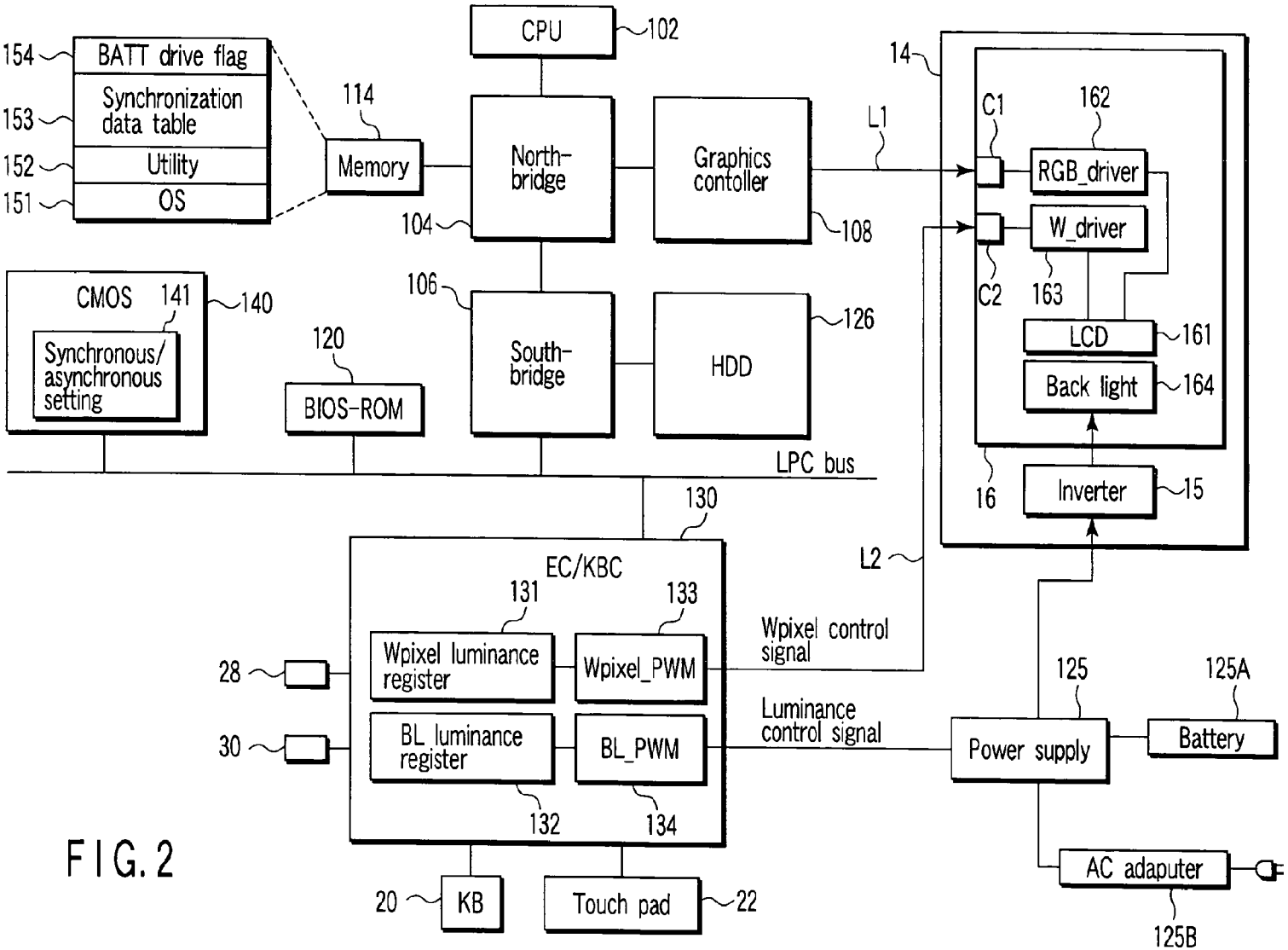
FIG. 2 is an exemplary block diagram showing an example of a circuit configuration of the personal computer according to the first embodiment.

As shown in FIG. 2, the present computer includes a CPU 102, a north bridge 104, a main memory 114, a graphics controller 108, a south bridge 106, a BIOS-ROM 120, a hard disk drive (HDD) 126, an embedded controller/keyboard controller IC (EC/KBC) 130, a power supply 125 and the like.

The display unit 14 has a display panel 16 having an LCD 161, an RGB drive circuit (RGB_driver) 162, a W drive circuit (W_driver) 163, a backlight 164, a first connector C1, and a second connector C2, and an inverter 15.

A color filter of the LCD 161 is of an RGBW type having filter segments of red, green, blue, and white (for example, clear and colorless). The backlight 164 is an illumination unit for illuminating the LCD 161 from a rear surface of the LCD 161 of a transmission type (or a translucent type). When the LCD 161 is a reflection type, a front-side light is used as an illumination unit for illuminating the LCD 161 from a side of a front side of the LCD 161. The inverter 15 boosts driving power supplied by the power supply 125, and supplies the boosted power supply to the backlight 164.

The CPU 102 is a processor provided for controlling operation of the present computer. The CPU 102 executes a variety of application programs including an operating system (OS) 151 and a utility 152 which are loaded into the main memory 114 from the hard disk drive (HDD) 126. In addition, on start-up, a synchronization data table 153 is loaded into the main memory 114.

In addition, the CPU 102 loads a system BIOS (Basic Input Output System) stored in the BIOS-ROM 120 into the main memory 114, and then executes the system BIOS. The system BIOS is a program for controlling hardware.

The north bridge 104 is a bridge device for connecting a local bus of the CPU 102 and the south bridge 106. The north bridge 104 incorporates a memory controller for access-controlling the main memory 114. In addition, the north bridge 104 has a function of executing communication with the graphics controller 108 via an AGP (Accelerated Graphics Port) bus, etc.

The graphics controller 108 is a display controller for controlling a red pixel, a green pixel, and a blue pixel of the LCD 161 which is used as a display monitor of the present computer. The graphics controller 108 has a video memory (VRAM). The graphics controller 108 generates a video signal for forming a display image to be displayed on the LCD 161 from display data rendered in a video memory by an OS and an application program. The video signal as a control signal generated by the graphics controller 108 is output to a signal line L1. The signal line L1 is connected to the first connector C1 provided in the display panel 16. The RGB drive circuit 162 provided in the display panel drives the red, green, and blue pixels of the LCD 161 based on the video signal supplied from the first connector C1.

The embedded controller/keyboard controller IC 130 carries out control of the touch pad 22, the scroll button 24, and the touch pad control button 26, and also functions as a controller for controlling luminance of the backlight and the white pixel of the LCD 161. The embedded controller/keyboard controller IC 130 is a one-chip microcomputer for monitoring and controlling a variety of devices (a periphery device, a sensor, a power supply circuit, etc.), regardless of a system state of the computer 10.

In addition, the EC/KBC 130 has a white pixel luminance register (Wpixel luminance register) 131, a backlight luminance register (BL luminance register) 132, a Wpixel_PWM circuit 133, and BL_PWM circuit 134. The white pixel luminance register 131 stored data for designating luminance of the white pixel of the LCD 161. The backlight luminance register 132 stores data for designating luminance of the backlight 171.

The Wpixel_PWM circuit 133 generates a PWM signal as a control signal based on the data stored in the white pixel luminance register 131. The PWM signal as a control signal generated by the Wpixel_PWM circuit 133 is output to a signal line L2. The signal line L2 is connected to the second connector C2 provided in the display panel 16. The W drive circuit 163 provided in the display panel drives the white pixel of the LCD 161 based on the video signal supplied from the second connector C2.

The BL_PWM circuit 134 generates a PWM signal as a control signal based on the data stored in the backlight luminance register 132. The power supply 125 supplies a driving power of a voltage value based on the PWM signal to the inverter 15. Power supply boosted by the inverter 15 is supplied to the backlight 164, thereby the backlight 164 illuminates.

When the power supply 125 is supplied with external power supply via an AC (alternate current) adapter 125B, the power supply 125 generates a system power to be supplied to each component of the present computer 10 by using the external power supply supplied from the AC adapter 125B. In addition, when the power supply 125 is not supplied with the external power supply via the AC adapter 125B, a system power supply to be supplied to each component of the present computer 10 (the computer main body 12 and the display unit (displaying unit) 14) is generated by using a battery 125A. Hereinafter, a case where a driving power of the computer main body 12 and the display unit 14 is the battery 125A is referred to as battery drive.

The power supply 125 has a function of interrupting to report a location where the system power source is generated to the EC/KBC 130 when the location where the system power source is generated changes. The EC/KBC 130 reports to the system BIOS the location where the system power source is generated. The system BIOS makes a BATT drive flag 154 on the main memory 114 to be enabled (battery drive) or disenabled (external power source drive) depending on the location where the system power source is generated.

Next, control of the white pixel will be described.

The control of the white pixel is carried out by the EC/KBC 130. The control of the white pixel has a synchronous mode in which the control of the white pixel and luminance control of the backlight are automatically carried out, and an asynchronous mode in which the luminance control of the backlight and the control of the white pixel can be independently set by the user.

Figures 3, 4:
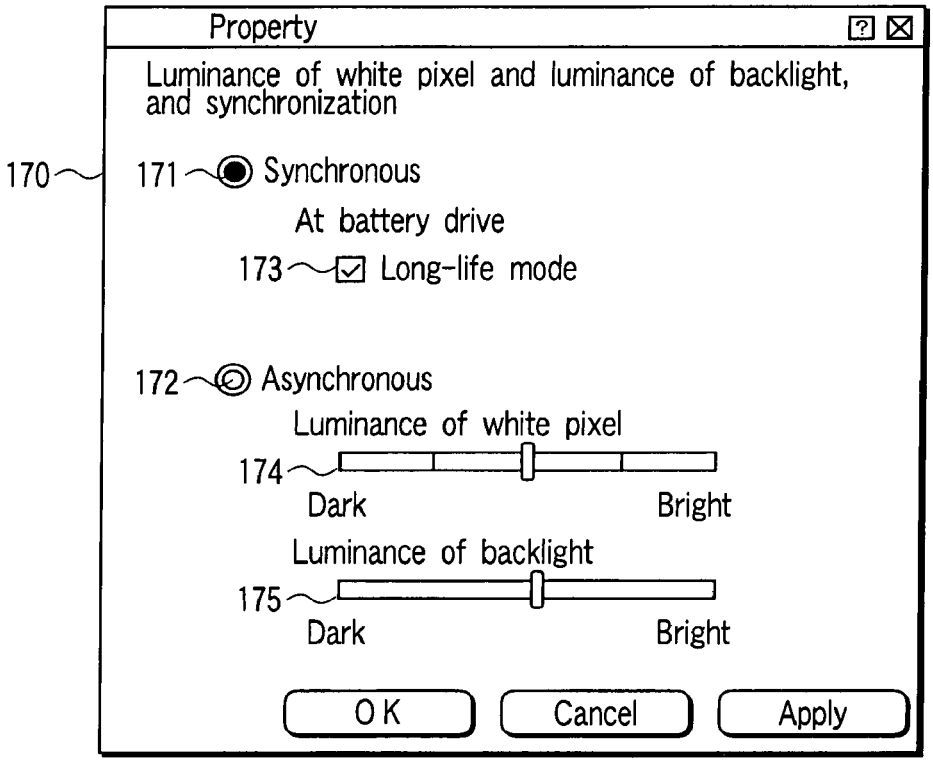
FIG. 3 is an exemplary view showing a window displayed by a utility on an LCD in order to switch over a synchronous mode and an asynchronous mode.
FIG. 4 is an exemplary view showing a content of a synchronization data table in a case of a transmission LCD.
Figure 7:
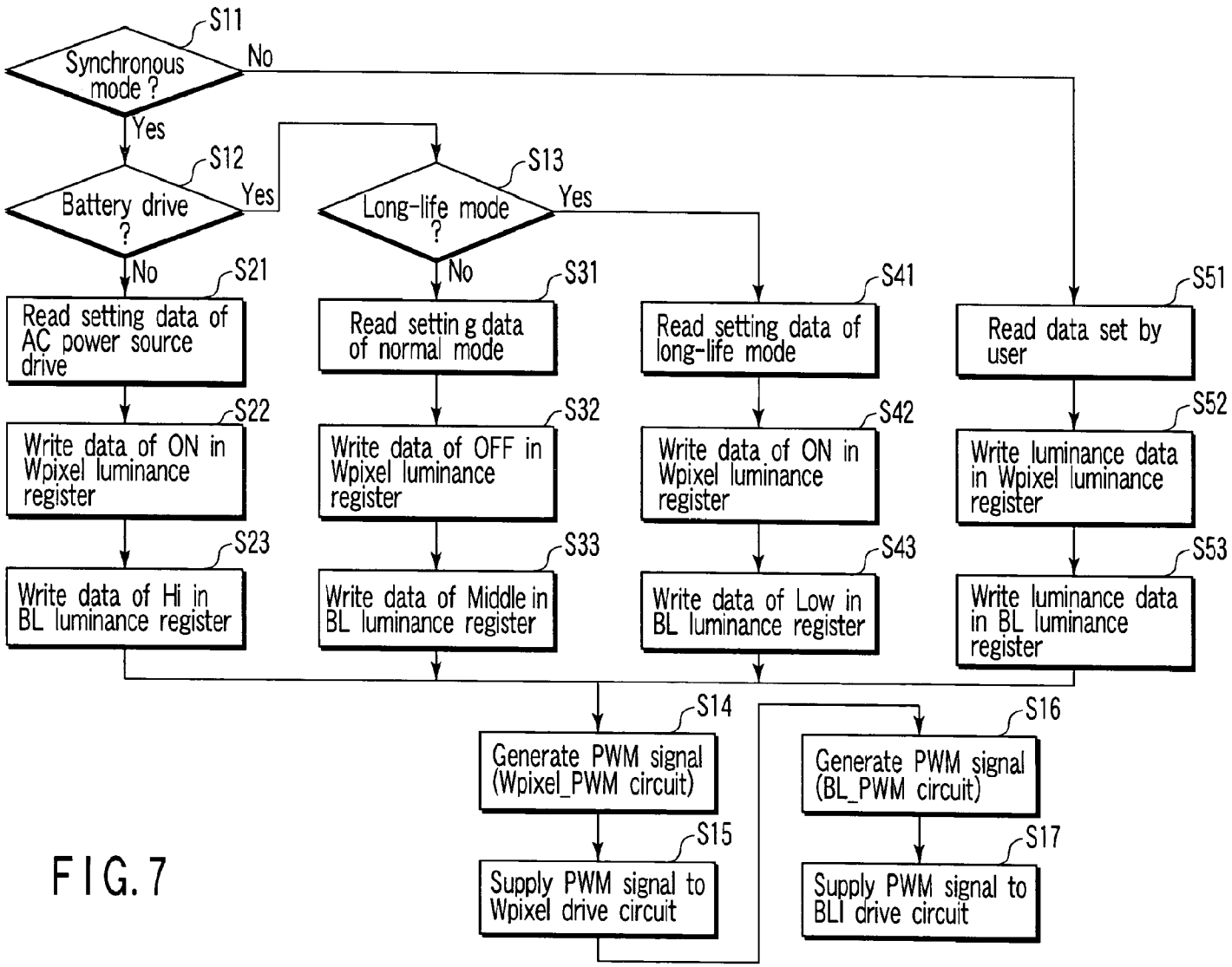
FIG. 7 is an exemplary flowchart showing steps of processing for setting luminance of a white pixel and backlight in a case of the transmission LCD.
Figure 8:
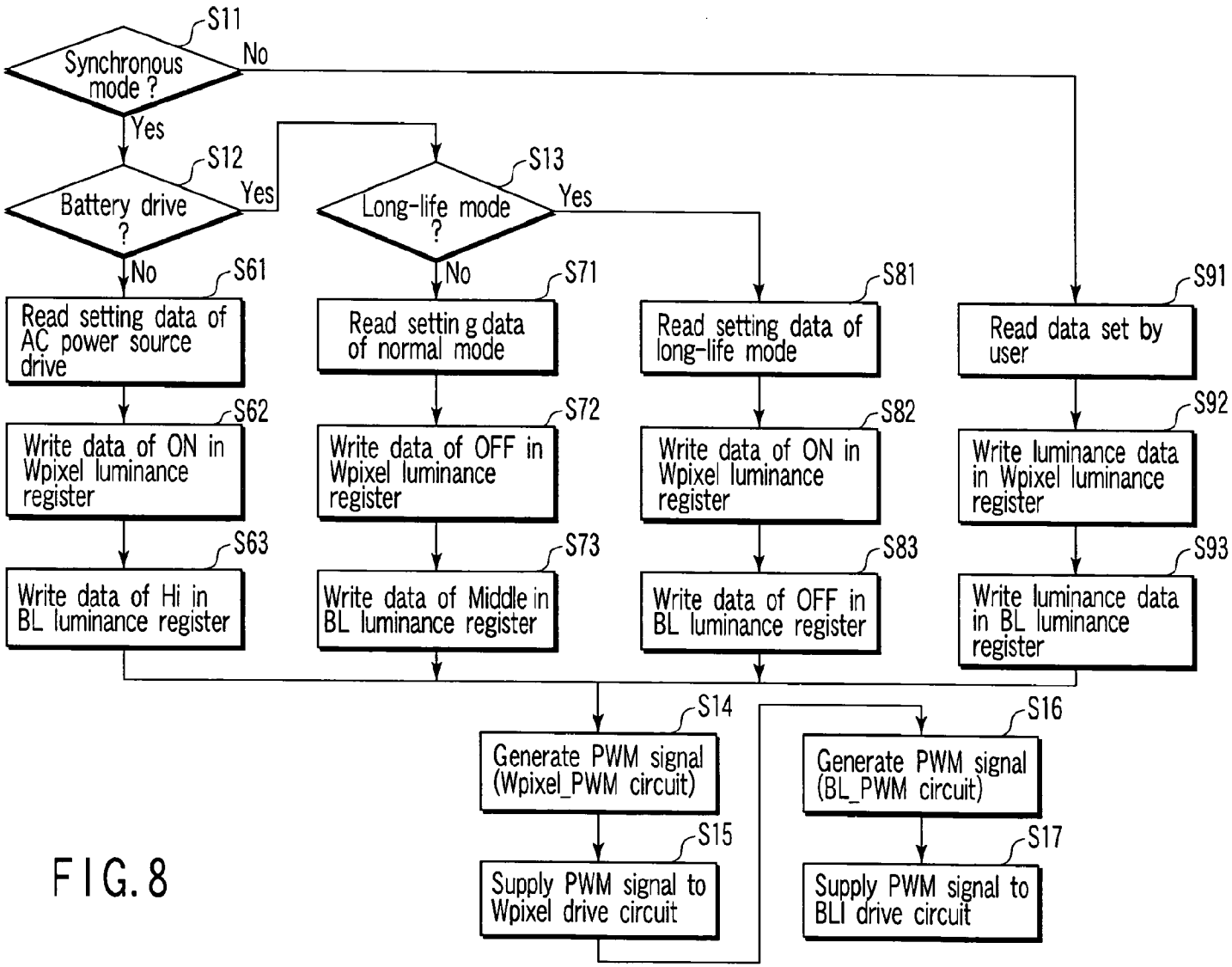
FIG. 8 is an exemplary flowchart showing steps of processing for setting luminance of a white pixel and backlight in cases of the translucent and the reflection LCDs.

Switching over of the synchronous mode and the asynchronous mode is carried out by the utility 152. FIG. 3 shows a window displayed on the LCD 161 by the utility 152 in order to switch over the synchronous mode and the asynchronous mode.

As shown in FIG. 3, in a window 170, there are provided a radio box 171 for selecting the synchronous mode and a radio box 172 for selecting the asynchronous mode. The radio box 171 and the radio box 172 can be exclusively selected. When one of the radio box 171 and the radio box 172 is selected in a state where the other one of the radio box 171 and the radio box 172 has been selected, a check mark of the other one of the radio box 171 and the radio box 172 automatically turns to be unchecked. Setting of whether the synchronous mode or the asynchronous mode is selected is stored in a synchronous/asynchronous setting 141 in a CMOS RAM 140 working as a memory device.

In the synchronous mode, the luminance of the white pixel and the backlight is controlled depending on setting data in the synchronization data table 153 which is loaded into the main memory 114 in the EC/KBC 130, for example. FIGS. 4, 5, and 6 show an example of a content of the synchronization data table 153. FIG. 4 is the content of the synchronization data table 153 in a case where the LCD 161 is of a transmission type. FIG. 5 is the content of the synchronization data table 153 in a case where the LCD 161 is of a translucent type. FIG. 6 is the content of the synchronization data table 153 in a case where the LCD 161 is of a reflection type.

In FIGS. 4, 5, and 6, high power is in a case of a system driven by an AC power source where electric power is supplied from the AC adapter 125B. In addition, a normal mode and a long-life mode are cases where the system is driven by the battery 125A. By enabling a check box 173 in the window 170 shown in FIG. 3, the long-life mode is selected. By disenabling the check box 173 to be unchecked, the normal mode is selected. Whether the long-life mode or the normal mode is selected is recorded in the synchronous/asynchronous setting 141.

When the asynchronous mode is selected, a slide bar 174 for setting the luminance of the white pixel and a slide bar 175 for setting the luminance of the backlight can be operated. The luminance of the white pixel can be set in four levels. The luminance of the backlight can be set in 256 levels. Values of the luminance of the white pixel and the backlight set by the user are recorded in the synchronous/asynchronous setting 141.

Next, steps of processing for setting the luminance of the backlight and the white pixel will be described as follows. The synchronous mode controls two states, an on state in which light from the backlight passes through the white pixel, and an off state in which the light from the backlight does not pass the white pixel. In addition, the backlight controls four states, Hi, Middle, Low, and Off. As to the control of the white pixel and the backlight, the control may be carried out with an increased number of stages.

Transmission LCD

First, a case in which the LCD 161 is of a transmission type will be described. On start-up, or when the mode is switched, the utility 152 refers to the synchronous/asynchronous setting 141 to judge whether the synchronous mode is selected or not (step S11). When the synchronous mode is judged as being selected (Yes in step S11), the utility 152 judges whether a current power supplying source of the system is the battery 125A or not (step S12).

When the power supplying source is judged as not the battery 125A (No in step S12), the setting data of the luminance of the white pixel and the backlight in the case of the AC power source drive is selected from the synchronization data table 153 and is read (step S21). Then, the utility 152 writes data corresponding to the on state of the white pixel in the white pixel luminance register 131 in the EC/KBC 130 (step S22). In addition, the utility 152 writes data corresponding to Hi of the backlight in the backlight luminance register 132 in the EC/KBC 130 (step S23). The order of step S22 and step S23 may be reversed.

When the power supply source is judged to be the battery 125A in the processing of step S12 (Yes in step S12), the utility 152 refers to the synchronous/asynchronous setting 141 and judges whether the long-life mode is selected or not (step S13). When the long-life mode is judged to be not selected (No in step S13), the utility 152 selects the setting data of the luminance of the white pixel and the backlight in a case of the normal mode from the synchronization data table 153 and reads the setting data (step S31). Then, the utility writes data corresponding to the off state of the white pixel in the white pixel luminance register 131 in the EC/KBC 130 (step S32). In addition, the utility 152 writes data corresponding to Middle of the backlight in the backlight luminance register 132 in the EC/KBC 130 (step S33). The order of step S32 and step S33 may be reversed.

When the long-life mode is judged to be selected in the processing of step S13 (Yes in step S13), the utility 152 selects the setting data of the luminance of the white pixel and the backlight in a case of the long-life mode from the synchronization data table 153 and reads the setting data (step S41). The utility 152 writes data corresponding to the on state of the white pixel in the white pixel luminance register 131 in the EC/KBC 130 (step S42). In addition, the utility 152 writes data corresponding to Low of the backlight in the backlight luminance register 132 in the EC/KBC 130 (step S43). The order of step S42 and step S43 may be reversed.

When the synchronous mode is judged as being not selected (No in step S11), the utility 152 reads the setting of the luminance of the white pixel and the backlight from the synchronous/asynchronous setting 141 (step S51). The utility 152 writes data corresponding to the setting of the luminance read into the white pixel luminance register 131 in the EC/KBC 130 (step S52). In addition, the utility 152 writes data corresponding to the read setting of the luminance of the backlight in the backlight luminance register 132 in the EC/KBC 130 (step S53). The order of step S52 and step S53 may be reversed.

After data is written in the Wpixel luminance register and the BL luminance register, the Wpixel_PWM circuit 133 generates a PWM signal corresponding to the data written in the white pixel luminance register 131 (step S14). A duty ratio of the PWM signal changes depending on a value of the data. The PWM signal generated by the Wpixel_PWM circuit 133 is sent as a control signal to the Wpixel drive circuit 162 provided in the display unit 14 (step S15). The Wpixel drive circuit 162 drives the white pixel depending on the PWM signal, and predetermined luminance is obtained. The BL_PWM circuit 134 generates a PWM signal corresponding to the data written in the backlight luminance register 132 (step S16). A duty ratio of the PWM signal changes depending on a value of the data. The PWM signal generated by the BL_PWM circuit 134 is sent as a control signal to the power supply 125 (step S17). The power supply 125 supplies a driving power corresponding to the control signal to the inverter 15. The inverter 15 boosts the driving power. The boosted power source is supplied to the backlight. The backlight illuminates with luminance corresponding to a voltage of the boosted power source.

Translucent LCD/Reflection LCD

Next, steps of the processing of the translucent LCD and that of the reflection LCD are similar, therefore will be described together. On start-up, or when the mode is switched, the utility 152 refers to the synchronous/asynchronous setting 141 to judge whether the synchronous mode is selected or not (step S11). When the synchronous mode is judged as being selected (Yes in step S11), the utility 152 judges whether a current power supplying source of the system is the battery 125A or not (step S12).

When the power supplying source is judged as not the battery 125A (No in step S12), the setting data of the luminance of the white pixel and the backlight in the case of the AC power source drive is selected from the synchronization data table 153 and is read (step S61). Then, the utility 152 writes data corresponding to the on state of the white pixel in the white pixel luminance register 131 in the EC/KBC 130 (step S62). In addition, the utility 152 writes data corresponding to Hi of the backlight in the backlight luminance register 132 in the EC/KBC 130 (step S63). The order of step S62 and step S63 may be reversed.

When the power supply source is judged to be the battery 125A in the processing of step S12 (Yes in step S12), the utility 152 refers to the synchronous/asynchronous setting 141 and judges whether the long-life mode is selected or not (step S13). When the long-life mode is judged to be not selected (No in step S13), the utility 152 selects the setting data of the luminance of the white pixel and the backlight in a case of the normal mode from the synchronization data table 153 and reads the setting data (step S71). Then, the utility writes data corresponding to the off state of the white pixel in the white pixel luminance register 131 in the EC/KBC 130 (step S72). In addition, the utility 152 writes data corresponding to Middle of the backlight in the backlight luminance register 132 in the EC/KBC 130 (step S73). The order of step S72 and step S73 may be reversed.

When the long-life mode is judged to be selected in the processing of step S13 (Yes in step S13), the utility 152 selects the setting data of the luminance of the white pixel and the backlight in a case of the long-life mode from the synchronization data table 153 and reads the setting data (step S81). The utility 152 writes data corresponding to the on state of the white pixel in the white pixel luminance register 131 in the EC/KBC 130 (step S82). In addition, the utility 152 writes data corresponding to Low of the backlight in the backlight luminance register 132 in the EC/KBC 130 (step S83). The order of step S82 and step S83 may be reversed.

When the synchronous mode is judged as being not selected (No in step S11), the utility 152 reads the setting of the luminance of the white pixel and the backlight from the synchronous/asynchronous setting 141 (step S91). The utility 152 writes data corresponding to the setting of the luminance read into the white pixel luminance register 131 in the EC/KBC 130 (step S92). In addition, the utility 152 writes data corresponding to the read setting of the luminance of the backlight in the backlight luminance register 132 in the EC/KBC 130 (step S93). The order of step S92 and step S93 may be reversed.

Processing after data is written in the Wpixel luminance register and the BL luminance register (steps S14 to S17) is similar to that in the case of the transmission LCD, and therefore description thereof is omitted.

As described above, the luminance of the backlight 15 is lowered at the time of the battery drive, and also the white pixel of the LCD 161 is made to be in the on state. Thereby, luminance sensed by the user is increased, and deterioration in visibility can be restricted.

Visibility may attempt to be improved in such a manner that, by the memory 114, algorithm showing luminance of the white pixel appropriate for luminance of the backlight set by the user is associated with the luminance of the backlight set by the user, so that the luminance of the white pixel is set automatically.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An information processing apparatus comprising:

a display unit comprising a liquid crystal display configured to display a red pixel, a green pixel, a blue pixel, and a white pixel, and an illumination unit configured to illuminate the liquid crystal display, a selecting unit configured to select one setting data item from a setting table including setting data items, the setting data items comprising a first setting data item data and a second setting data item, the first setting data item comprising (i) a first luminance setting of the white pixel to be in an ON state and (ii) a second luminance setting of the illumination unit, the second setting data item comprising (iii) a third luminance setting of the white pixel to be in an OFF state and (iiii) a fourth luminance setting of the illumination unit, wherein luminance of the illumination unit corresponding to the second luminance setting is lower than luminance of the illumination unit corresponding to the fourth luminance setting; and a controller configured to control luminance of the white pixel based on the one setting data item, wherein the illumination unit is configured to illuminate the liquid crystal display when the selecting unit selects the first setting data item.

2. The apparatus of claim 1, further comprising a power supply configured to generate driving power; and a judging section configured to judge whether the power supply originates from a battery or an AC adapter to generate the driving power, wherein the selecting unit selects one the setting data item from the setting table corresponding to the source of power.

3. The apparatus of claim 2, wherein the setting table comprises a first setting data to be selected when the judging section judges that the battery is used to generate the driving power, and a second setting data corresponding to driving time by the battery that is longer than when the first setting data is selected, the information processing apparatus further comprising:

a setting section for a user to set whether the selecting unit selects any one of the setting data of the first setting data and the second setting data, when the judging section judges that the battery is used to generate the driving power; and a storage apparatus configured to store information set by the setting section.

4. The apparatus of claim 1, further comprising a luminance setting section for a user to set the luminance of the white pixel and the illumination unit; and a selecting unit setting section for a user to set whether the selecting unit needs to select one of the setting data stored in the setting table and the setting of luminance of the white pixel and the illumination unit set by the user using the luminance setting section.

5. A control method of an information processing apparatus comprising a displaying unit, the displaying unit comprising a liquid crystal display comprising a red pixel, a green pixel, a blue pixel, and a white pixel, and an illumination unit configured to illuminate the liquid crystal display, the method comprising:

selecting one setting data item from a setting table that comprises a plurality of setting data items, the setting data items comprising a first setting data item and a second setting data item, the first setting data item comprising (i) a first luminance setting of the white pixel to be in an ON state and (ii) a second luminance setting of the illumination unit, the second setting data item comprising (iii) a third luminance setting of the white pixel to be in an OFF state and (iiii) a fourth luminance setting of the illumination unit, wherein luminance of the illumination unit corresponding to the second luminance setting is lower than luminance of the illumination unit corresponding to the fourth luminance setting;

controlling, luminance of the white pixel based on the one setting data item.

6. The method of claim 5, further comprising judging whether a power supply which is configured to generate originates from a battery or from an AC adapter to generate the driving power; and selecting one setting data item from the setting table depending on a result of the judgment for the selecting of the setting data.

7. The method of claim 6, wherein the setting table comprises a first setting data to be selected when the battery is judged to be used to generate power, and a second setting data that sets the driving time by the battery to be longer than when the first setting data is selected, and wherein the apparatus further comprises a storage apparatus configured to store a setting of whether any one of the setting data of the first setting data and the second setting data needs to be selected when the battery is judged to be used to generate power, the method further comprising:

referring to the setting stored in the storage apparatus when the battery is judged to be used to generate power; and selecting one of the first and the second setting data depending on the reference result.

8. The method of claim 5, wherein the apparatus further comprises a luminance setting section for a user to set luminance of the white pixel and the illumination unit, setting data stored in the setting table, and a selecting unit setting section for a user to set whether the selecting unit needs to select one of settings of luminance of the white pixel and the illumination unit set by the user using the luminance setting section, the method further comprising:

judging which of the setting data stored in the setting table and the luminance set by the user in the setting means needs to be selected; and setting the luminance of the white pixel and the illumination unit depending on the data judged.

* * * * *